US005164691A

United States Patent [19]

Wakino et al.

[11] Patent Number: 5,164,691

[45] Date of Patent: Nov. 17, 1992

[54] FIXING STRUCTURE OF DIELECTRIC RESONATOR

[75] Inventors: Kikuo Wakino; Atsushi Inoue; Fumiaki Kinoshita, all of Nagaokakyo, Japan

[73] Assignee: Murata Manufacturing Co., Ltd., Kyoto, Japan

[21] Appl. No.: 634,733

[22] Filed: Dec. 27, 1990

[30] Foreign Application Priority Data

Dec. 27, 1989 [JP] Japan ..... 1-344768
Jan. 22, 1990 [JP] Japan ..... 2-13174

[51] Int. Cl.[5] ..... H01P 7/10
[52] U.S. Cl. ..... 333/219.1; 331/96
[58] Field of Search ..... 333/219.1, 219, 202, 333/235; 331/68, 96, 107 DP

[56] References Cited

U.S. PATENT DOCUMENTS 4,821,006 4/1989 Ishikawa et al. ..... 333/219.1 X

FOREIGN PATENT DOCUMENTS 0039042 4/1978 Japan ..... 333/235
0072203 4/1987 Japan ..... 333/219.1

*Primary Examiner*—Eugene R. LaRoche
*Assistant Examiner*—Seung Ham
*Attorney, Agent, or Firm*—Wenderoth, Lind & Ponack

[57] ABSTRACT

Structure for use in forming a resonant circuit eliminates a support block for the installation of a dielectric resonator, by providing a satisfactory way to directly install the dielectric resonator on a microwave circuit board having a microstrip line. The dielectric resonator is directly fixed on the microwave circuit board in such a manner that mutually opposing planar surfaces thereof do not face one planar surface of the microwave circuit board, and an axial line passing normally through these planar surfaces intersects a normal plane projected from the microstrip line. As a result, production costs can be reduced and simplified work processes can be used to fabricate the structure. Further, an electrode film may be formed on a flat part of the outer periphery of the dielectric resonator, and such a dielectric resonator is fixed on the microwave circuit board with the flat part on which said electrode film is formed, facing upwards. As a result, a metallic case which is to cover the microwave circuit board can be brought close to the dielectric resonator, thereby achieving a compact overall structure.

3 Claims, 2 Drawing Sheets

FIXING STRUCTURE OF DIELECTRIC RESONATOR

BACKGROUND OF THE INVENTION

The present invention relates to a dielectric resonator and more particularly to a dielectric resonator provided on a microwave circuit board, the dielectric resonator defining mutually opposing planar surfaces and an outer peripheral surface extending between these planar surfaces and which resonates in the $TE_{01\delta}$ mode, and a microstrip line to which the dielectric resonator is magnetically coupled.

Conventionally, a dielectric resonator of this type which resonates in the $TE_{01\delta}$ mode is fixed on a microwave circuit board in the manner shown in FIG. 7.

In this figure, a dielectric resonator 11 is made of dielectric material and has a columnar shape defining mutually opposing planar surfaces 11*a*, 11*b* and an outer peripheral surface 11*c* extending between these planar surfaces 11*a*, 11*b*. The direction of a normal axis passing through these mutually opposing planar surfaces 11*a*, 11*b* is the one in which a microwave advances. A support block 12 is made of insulating material, and is fixed to one planar surface 11*b* of the dielectric resonator 111 with an adhesive or the like, and is also fixed on the top surface of a microwave circuit board 13 with an adhesive or the like. The dielectric resonator 11 is fixed in such a manner that its planar surfaces 11*a*, 11*b* are parallel to the plane of the microwave circuit board 13.

The microwave circuit board 13 is made of dielectric material and a microstrip line 14 is formed on its top surface while a ground conductor 15 is formed on its bottom surface. The dielectric resonator 11 is fixed in position close to the microstrip line 14.

In the structure described above, a magnetic field is formed in the direction of the normal axis passing through the mutually opposing planar surfaces 11*a*, 11*b* of the dielectric resonator 11, and as shown in FIG. 8, magnetic flux F, which forms the magnetic field, envelops the microstrip line 14.

Thus, the dielectric resonator 11 is magnetically coupled with the microstrip line 14, forming a resonance circuit. Therefore, adjusting the distance l between the dielectric resonator 11 and the microstrip line 14 allows the degree of their mutual coupling to be correspondingly adjusted, thus resulting in adjustments of resonance circuit characteristics.

In the prior art structure described above, the dielectric resonator 11 is raised to a specified height using the support block 12. This is because when the planar surfaces 11*a*, 11*b* of the dielectric resonator 11 are too close to the ground conductor 15 of the microwave circuit board 13, the rate of magnetic flux in contact with the ground conductor 15 increases, which in turn causes an increase in eddy-current loss, resulting in a decrease in a Q value of the resonance circuit.

Therefore, the support block 12 became indispensable, which brought about an increase in the number of members with the resultant increase in production costs and also with the necessity for fixing the support block 12 to the dielectric resonator 11, thus causing a problem of the production process being complicated.

SUMMARY OF THE INVENTION

Accordingly, it is an object of the present invention to provide a structure for use in forming a resonant circuit in which a support block is unnecessary to install a dielectric resonator on a microwave circuit board, thereby reducing production costs and simplifying the production processes.

In order to solve such problems as described above, the first embodiment of the present invention comprises a dielectric resonator, a microwave circuit board, a microstrip line and a ground conductor, the dielectric resonator resonating in the $TE_{01\delta}$ mode and also defining mutually opposing planar surfaces and an outer peripheral surface extending between the planar surfaces, the microwave circuit board being made of dielectric material, the microstrip line extending on one planar surface and the ground conductor on the other planar surface of the microwave circuit board, the microstrip line being magnetically coupled to the dielectric resonator, and the resonator being oriented such that the mutually opposing planar surfaces do not face the one planar surface of the microwave circuit board, and such that an axial line passing normally through both planar surfaces of the resonator intersects a plane projected from the microstrip line. The dielectric resonator is directly fixed on the one planar surface of the microwave circuit board in such an orientation.

Similarly, the second embodiment of the present invention comprises a dielectric resonator, a microwave circuit board, a microstrip line and a ground conductor, the dielectric resonator resonating in the $TE_{01\delta}$ mode and also defining opposing planar surfaces and an outer peripheral surface extending between these planar surfaces and part of which is a flat surface extending normally to the opposing planar surfaces, an electrode film being formed on the flat part, the microwave circuit board being made of dielectric material, the microstrip line being formed on one planar surface and the ground conductor on the other planar surface of the microwave circuit board, the microstrip line being magnetically coupled with the dielectric resonator, and the dielectric resonator being oriented such that the mutually opposing surfaces do not face the one planar surface of the microwave circuit board, and such that an axial line passing normally through both of the planar surfaces intersects a plane projected from the microstrip line. The dielectric resonator is directly fixed on the aforementioned one planar surface of the microwave circuit board in such an orientation, with the flat part on which the electrode film is formed, facing upwards.

Because the dielectric resonator is arranged in such a manner that the mutually opposing planar surfaces do not face the one planar surface of the microwave circuit board, and the axial line passing normally through the mutually opposing planar surfaces intersects a plane projected from the microstrip line, the magnetic flux in contact with the ground conductor does not increase as in the prior art even if the dielectric resonator is in close proximity to the microwave circuit board. Therefore, a resonance circuit can be formed without reducing the Q value very much, and the dielectric resonator can therefore be directly fixed to the microwave circuit board without a support block as used in the prior art.

Furthermore, in the second embodiment of the invention, a flat part is formed on at least part of the outer periphery of the dielectric resonator, an electrode film is formed on this flat part, and the dielectric resonator is directly fixed to the microwave circuit board with the flat part on which this electrode film is formed, facing upwards. Thus, almost no magnetic flux will be generated above the flat part. Therefore, even if a metallic case which is to cover the microwave circuit board is placed close to the dielectric resonator, the Q value does not decrease very much, thereby making a support block unnecessary as well as allowing the metallic case to be smaller in height compared to the prior art. Namely, the microwave circuit board 13 is usually covered by a metallic case. When this metallic case is too close to the dielectric resonator 11, the Q value of the resonance circuit decreases as in the case of the ground conductor 15, which fact made it difficult to provide a metallic case of a small height in the prior art. However, this second invention makes it possible to provide such a metallic case having a small height.

Because an electrode film is formed on the flat part of the outer periphery of the dielectric resonator, the dielectric resonator provides a characteristic which is as if a dielectric which is the same shape as that below the electrode film also exists symmetrically above the electrode film. Therefore, such a characteristic of the dielectric resonator does not cause a practical problem.

DETAILED DESCRIPTION OF THE PREFERRED EMBODIMENTS

The preferred embodiments of structure for use in forming a resonant circuit according to the present invention will be hereinafter explained with reference to FIG. 1 through FIG. 6 of the accompanying drawings.

Figure 1:
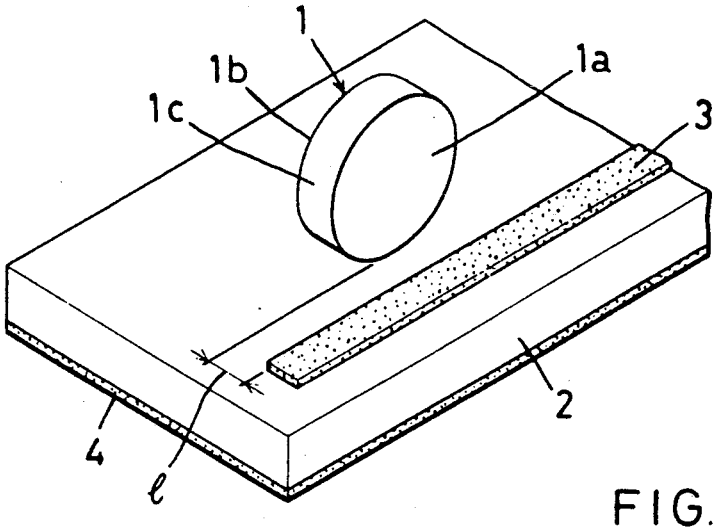
FIG. 1 is a perspective view of the first embodiment of structure for use in forming a resonant circuit.
Figure 2:
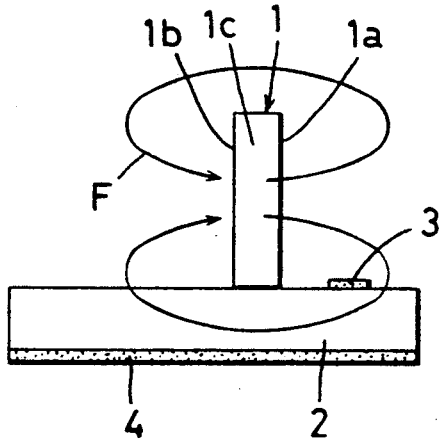
FIG. 2 is a side elevational view of the aforementioned embodiment.

In the first embodiment illustrated in FIGS. 1 and 2, a dielectric resonator 1 resonates in the $TE_{01\delta}$ mode and defines mutually opposing planar surfaces 1*a*, 1*b*, and a cylindrical outer peripheral surface 1*c* extending between these planar surfaces 1*a*, 1*b*.

In this dielectric resonator 1, one planar surface 1*a* faces a microstrip line 3 on a microwave circuit board 2 and the outer peripheral surface 1*c* is fixed with an appropriate adhesive in the neighborhood of the microstrip line 3 on the microwave circuit board 2. The microwave circuit board 2 is a structure similar to that of the prior art, and a ground conductor 4 is formed on its bottom surface.

In the first embodiment of the present invention, a magnetic field is formed in the direction of a normal axis passing through the planar surfaces 1*a*, 1*b* of the dielectric resonator 1. Magnetic flux F which forms this magnetic field envelops the microstrip line 3 as illustrated in FIG. 2.

In this case, the planar surfaces 1*a*, 1*b* do not face the plane of the microwave circuit board 2. Therefore, even if the dielectric resonator 1 is in close proximity to the microwave circuit board 2, the Q value of a resonance circuit does not decrease very much.

Thus the dielectric resonator 1 is magnetically coupled with the microstrip line 3, forming a resonance circuit. Therefore, by adjusting the distance l between the dielectric resonator 1 and the microstrip line 3 as in the prior art, the degree of their coupling can be correspondingly adjusted, resulting in adjustments of resonance circuit characteristics.

Figure 3:
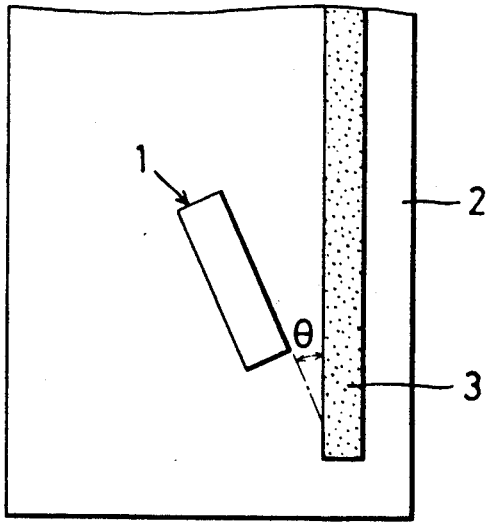
FIG. 3 is a plan view of the major part of a modified form of the aforementioned embodiment.

Furthermore, the dielectric resonator 1 may be arranged obliquely at an angle $\theta$ to the microstrip line 3 as illustrated in FIG. 3. In brief, if the dielectric resonator 1 is arranged in such a manner that the planar surfaces 1*a*, 1*b* of the dielectric resonator 1 do not face the plane of the microwave circuit board 2 and is also arranged such that an axial line passing normally through the mutually facing planar surfaces 1*a*, 1*b* intersects the microstrip line 3, then a magnetic coupling of both members can be maintained. When the dielectric resonator 1 is thus obliquely arranged, the angle $\Theta$ corresponds to resonance circuit characteristics.

Furthermore, the dielectric resonator 1 is not necessarily column-shaped as in the aforementioned embodiment and may therefore be square-column shaped, cylindrical or otherwise. Still furthermore, the dielectric resonator 1 may be arranged so that it overlaps the microstrip line 3.

Figure 4:
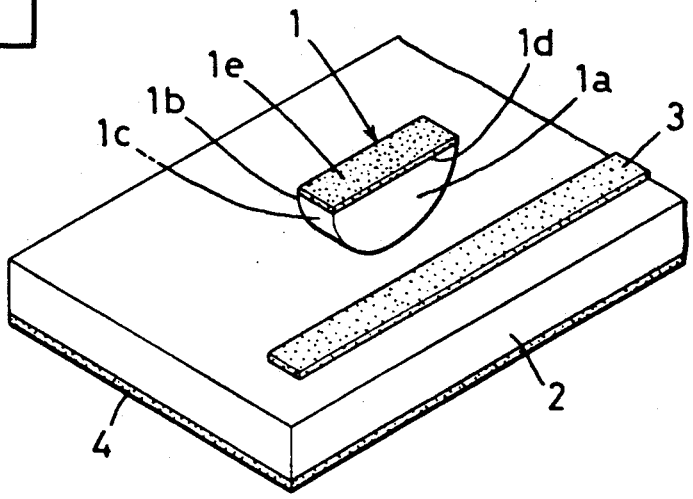
FIG. 4 is a perspective view of a second embodiment of structure for use in forming a resonant circuit.
Figure 5:
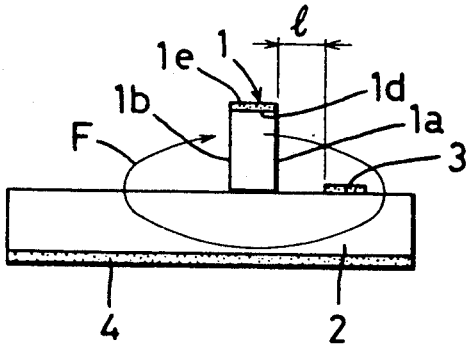
FIG. 5 is a side elevational view of the aforementioned embodiment.
Figure 6:
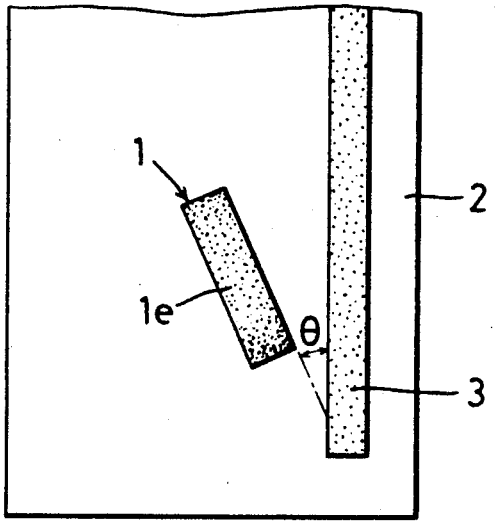
FIG. 6 is a plan view of a modified form of the aforementioned embodiment.
Figure 7:
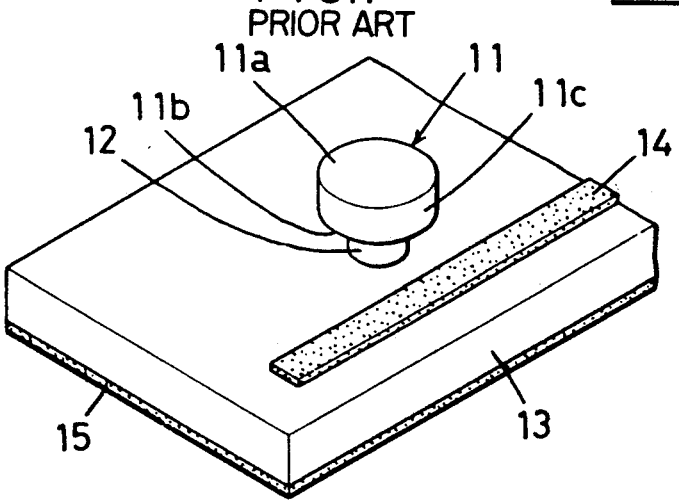
FIG.7 PRIOR ART
FIG. 7 is a perspective side view of the major part of a microwave circuit board illustrating a dielectric resonator prior to the present invention.
Figure 8:
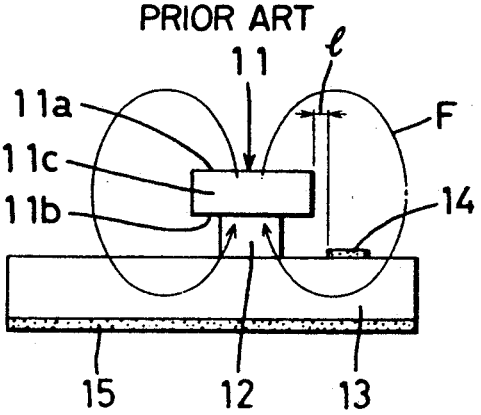
FIG.8 PRIOR ART
FIG. 8 is a side elevational view of the same.

Next, the second embodiment as illustrated in FIGS. 4 through 6 will be described. Members and parts which are the same as those used in the first embodiment illustrated in FIGS. 1 through 3 will be designated by the same reference symbols.

This second embodiment makes a support block unnecessary for the installation of a dielectric resonator as in the case of the aforementioned first embodiment, and it also makes it possible to use a metallic case having a comparatively small height.

In FIGS. 4 and 5, the dielectric resonator 1 resonates in the $TE_{01\delta}$ mode, and defines mutually opposing planar surfaces 1*a*, 1*b*, and an outer peripheral surface 1*c* extending between these planar surfaces 1*a*, 1*b* and including a flat part 1*d*. Namely, this dielectric resonator 1 has a half-column shape obtained by cutting a truly column-shaped dielectric resonator, shown in the prior art embodiment, exactly into halves in the direction of an axis passing normally through planar surfaces 1*a*, 1*b*. An electrode film 1*e* is formed on the flat part 1*d* which corresponds to this cut surface.

In this dielectric resonator 1, one planar surface 1*a* faces the microstrip line 3 on the microwave circuit board 2 and the outer peripheral surface 1*c* is fixed with an appropriate adhesive in the neighborhood of the microstrip line 3 on the microwave circuit board 2, with the flat part 1*d* on which the electrode film 1*e* is formed, facing upwards. The microwave circuit board 2 is of the same configuration as that in the prior art and a ground conductor 4 is formed on the bottom surface of the microwave circuit board 2.

In the second embodiment of the present invention, a magnetic field is formed in the direction of the axis passing normally through the flat planar surfaces 1*a*, 1*b* of the dielectric resonator 1. Magnetic flux F which forms this magnetic field envelops the microstrip line 3 as shown in FIG. 5. In this case, the planar surfaces 1*a*, 1*b* do not face the plane of the microwave circuit board 2. Therefore, even if the dielectric resonator 1 is in close proximity to the microwave circuit board 2, the Q value of a resonance circuit does not decrease very much.

Furthermore, since the dielectric resonator 1 is half-column shaped and the flat part 1*d* on which an electrode film 1*e* is formed faces upwards, magnetic flux is hardly formed above the flat part 1*d*. Therefore, even if a metallic case which is to cover the microwave circuit board is brought close to the dielectric resonator 1, the Q value does not decrease very much. This makes it possible to eliminate the prior art support block, which in turn reduces the required height of a metallic case.

The dielectric resonator 1 is half-column shaped and is therefore only half the size of that of the prior art. However, due to the existence of an electrode film 1*e*, the dielectric resonator provides a characteristic which is as if a dielectric symmetrical in shape to that below the electrode film le also exists above the electrode film 1*e*. Therefore, this characteristic does not cause any practical problem.

Thus, the dielectric resonator 1 is magnetically coupled with the microstrip line 3, forming a resonance circuit. Therefore, adjusting the distance l between the dielectric resonator 1 and the microstrip line 3 in the same manner as in the prior art, allows the degree of their coupling to be adjusted, thus resulting in adjustments of resonance circuit characteristics.

As illustrated in FIG. 6, the dielectric resonator 1 may be arranged obliquely at an angle Θ to the microstrip line 3 as in FIG. 3 showing the first embodiment.

Furthermore, the dielectric resonator 1 does not necessarily have to be half-column shaped as in the aforementioned embodiment and if a flat part is formed on at least part of the outer periphery, the dielectric resonator 1 may be square-column shaped or of any other shape. In brief, the dielectric resonator 1 should be of a shape obtained by cutting a dielectric resonator of a fundamentally required shape into substantial halves in size in the direction of an axis passing normally through its mutually opposing planar surfaces, and an electrode film should then be formed on a flat part which corresponds to the cut surface at the outer periphery. Furthermore, the dielectric resonator 1 may be arranged in such a manner that it overlaps the microstrip line 3.

As is clear from the above explanations, according to the present invention, since a dielectric resonator is arranged in such a manner that planar surfaces of the dielectric resonator do not face the plane of a microwave circuit board and is also arranged such that an axial line passing normally through the mutually opposing planar surfaces intersects a microstrip line, it is possible to install a dielectric resonator directly on a microwave circuit board, eliminating the support block used in the prior art. As a result, reduced production costs and simplified work processes can be attained.

Further, in the second embodiment of the invention, a flat part is formed on at least part of the outer periphery of the dielectric resonator, an electrode film being formed on this flat part, and the dielectric resonator is fixed on a microwave circuit board with the flat part, on which this electrode film is formed, facing upwards. This allows a metallic case which is to cover the microwave circuit board to be brought close to the dielectric resonator, thus allowing a metallic case of a reduced height to be used.

What is claimed is:

1. Structure for use informing a resonance circuit, said structure comprising: a microwave circuit board of dielectric material having upper and lower planar surfaces; a microstrip line extending in a direction along the upper planar surface of said microwave circuit board; a ground conductor disposed on the lower planar surface of said microwave circuit board; and a dielectric resonator which will resonate in the $TE_{01\delta}$ mode and directly fixed to said microwave circuit board on said upper planar surface thereof at such a position that said microstrip is magnetically coupled with the resonator, said dielectric resonator having mutually opposing planar surfaces and an outer peripheral surface extending between said opposing planar surfaces, and said dielectric resonator being oriented on said microwave circuit board such that said opposing planar surfaces of the resonator do not face the upper planar surface of said microwave circuit board, such that an axis normal to said opposing planar surfaces intersects a plane projected from said microstrip normal to the upper planar surface of said microwave circuit board, and such that said opposing planar surfaces lie in planes extending obliquely at an angle to the direction in which said microstrip extends on the upper planar surface of said microwave circuit board.

2. Structure for use in forming a resonance circuit, said structure comprising: a microwave circuit board of dielectric material having upper and lower planar surfaces; a microstrip line extending in a direction along the upper planar surface of said microwave circuit board; a ground conductor disposed on the lower planar surface of said microwave circuit board; and a dielectric resonator which will resonate in the $TE_{01\delta}$ mode and directly fixed to said microwave circuit board on said upper planar surface thereof at such a position that said microstrip is magnetically coupled with the resonator, said dielectric resonator having mutually opposing planar surfaces, an outer peripheral surface extending between said opposing planar surfaces, part of said outer peripheral surface being flat, and an electrode film disposed on the flat part of said outer peripheral surface, and said dielectric resonator being oriented on said microwave circuit board such that said opposing planar surfaces of the resonator do not face the upper planar surface of said microwave circuit board, such that an axis normal to said opposing planar surfaces intersects a plane projected from said microstrip normal to the upper planar surface of said microwave circuit board, and such that the flat part of said outer peripheral surface faces upward away from the upper planar surface of said microwave circuit board.

3. Structure for use in forming a resonance circuit as claimed in claim 2, wherein said dielectric resonator is also oriented on said microwave circuit board such that said opposing planar surfaces lie in planes extending obliquely at an angle to the direction in which said microstrip extends on the upper planar surface of said microwave circuit board.

* * * * *